US005096164A

United States Patent [19]

Luven et al.

[11] Patent Number: 5,096,164

[45] Date of Patent: Mar. 17, 1992

[54] STEEL-PROCESSING VESSEL HAVING A GRAPHITE ROD HEATING MEANS

[75] Inventors: Arno Luven, Krefeld; Heinz Holtermann, Meerbusch, both of Fed. Rep. of Germany

[73] Assignee: Technometal Gesellschaft für Metalltechnologie GmbH, Duisburg, Fed. Rep. of Germany

[21] Appl. No.: 542,581

[22] Filed: Jun. 25, 1990

[51] Int. Cl.[5] ..... C21C 7/10

[52] U.S. Cl. ..... 266/209; 266/208

[58] Field of Search ..... 266/207, 208, 209, 210

[56] References Cited

U.S. PATENT DOCUMENTS 3,027,150 3/1962 Harders ..... 266/210

4,378,242 3/1983 Harris et al. ..... 266/208

FOREIGN PATENT DOCUMENTS 0761576 9/1980 U.S.S.R. ..... 266/208

*Primary Examiner*—S. Kastler

*Attorney, Agent, or Firm*—Robert W. Becker & Associates

[57] ABSTRACT

A vessel for processing steel under vacuum is provided and includes a vessel body, a cover placed thereupon in a vacuum-tight manner, and a connection for a vacuum pump. To heat the vessel a heating mechanism is provided that comprises a graphite rod that extends diametrically through the vessel, with contact studs being provided at the ends of the graphite rod for the transfer of electrical power. To increase the service life of the graphite rods, the rod with its contact studs is fixably held in position on the vessel wall at one end, and at the opposite end the rod is displaceably disposed relative to the vessel wall. To compensate the force originating from the vacuum that prevails in the vessel, a compensating mechanism that is acted upon by the vacuum of the vessel is provided for supporting the moveable mounting of the graphite rod.

8 Claims, 3 Drawing Sheets

STEEL-PROCESSING VESSEL HAVING A GRAPHITE ROD HEATING MEANS

BACKGROUND OF THE INVENTION

The present invention relates to a vessel for processing steel under vacuum, and includes a vessel body, a cover placed thereupon in a vacuum-tight manner, and a connection for a vacuum pump, whereby to heat the vessel a heating means is provided that comprises a graphite rod that extends diametrically through the vessel, with contact studs being provided at the ends of the graphite rod for the transfer of electrical power.

With graphite rod heating means for steel-processing vessels, the mounting of the graphite rod, with its connections, especially contact studs, at its ends, in the vessel body presents a problem since as the vessel body, with its inner refractory lining, is heated up, the vessel body has a different expansion characteristic than does the graphite rod. This problem is accentuated by the fact that the openings in the walls of a vessel for the graphite rod must have a vacuum-tight configuration. In this connection, the vacuum that prevails in the interior of the vessel also acts upon the contact studs of the graphite rod, and upon the other connections, and leads to an oppositely directed stress that is directed into the interior of the vessel, as a consequence of which corresponding stresses occur in the graphite rod. The result is that the heretofore known graphite rod heating means have only a relatively short service life because due to the aforementioned conditions stresses occur in the graphite rod that lead to a premature failure of the rod or at least to a nonuniform consumption of the graphite rod.

DE-OS 36 37 065 discloses a steel-processing vessel of the aforementioned general type where the graphite rod is held in an intermediate ring that is supposed to be disposed between the vessel body and the cover. With this known arrangement, the intermediate ring should be embodied in such a way that it takes into account the expansion of the graphite rod during the heating phase and at the same time follows the stress that results from the vacuum. However, it has been shown that the approach described in DE-OS 36 37 061 is technically very complicated and can be realized in only a complicated and expensive manner It is therefore an object of the present invention to provide a vacuum-tight vessel for processing steel that is provided with a graphite rod heating means where the different expansion characteristics as well as the prevailing vacuum are taken into consideration and therefore the service life of the graphite rods for the heating means is prolonged.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
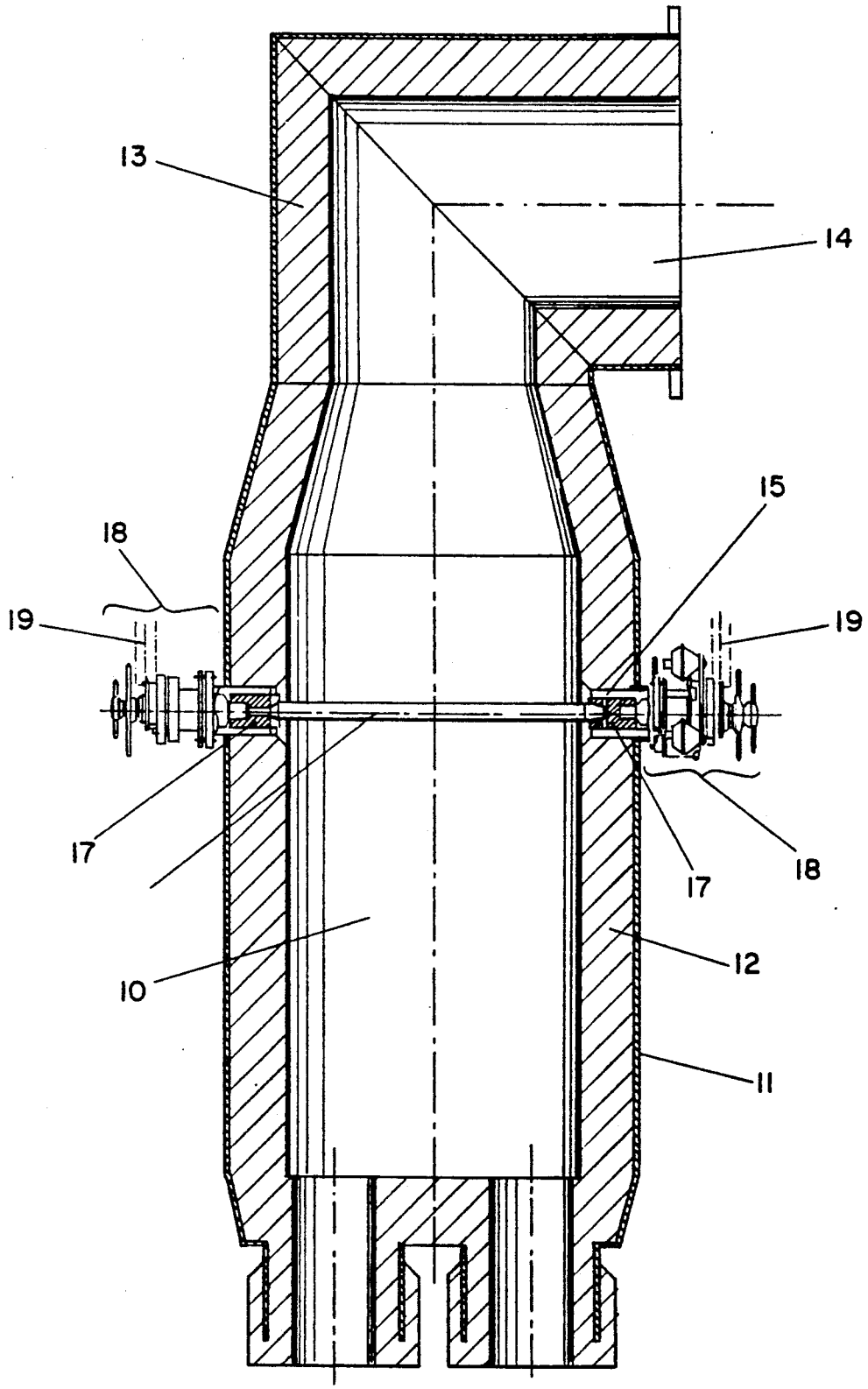
FIG. 1 is an overall view of one exemplary embodiment of the inventive vessel.

The vessel of the present invention is characterized primarily in that the graphite rod with its contact studs is fixedly held in position on the wall of the vessel at one end, and at the opposite end is disposed in such a way as to be displaceable relative to the wall of the vessel, and in that to compensate for the force originating from the vacuums that prevails in the vessel, a compensating mechanism that is acted upon by the vacuum of the vessel is provided for supporting the displaceable or moveable end of the graphite rod.

Pursuant to one preferred specific embodiment of the present invention, on both sides the holding means for the graphite rod, in other words both the fixed mounting as well as the movable mounting for the graphite rod, comprise an adapter, the contact stud, a contact ring that has connections for the power supply, an outer bushing that surrounds the contact ring, as well as a clamping means for the contact stud.

Since when the graphite rod heating means is placed into operation a pretensioning is desired for the graphite rod, there is provided, on the end of the displaceable arrangement of the mounting means for the graphite rod, between the wall of the vessel and the mounting means that is displaceable relative thereto, a spring arrangement for producing a pretension, with the compensating mechanism being supported between the wall of the vessel and the mounting means for the graphite rod and counteracting the force of this spring arrangement. This is because due to the vacuum that prevails in the interior of the vessel the set preload of the spring arrangement that acts in a direction toward the interior of the vessel is intensified, so that the tension that acts upon the graphite rod due to the effect of the load originating from the vacuum becomes too great. The compensating mechanism that is controlled by the vacuum of the vessel therefore provides a counter tension that is directed in a direction opposite to the spring effect and therefore maintains the set spring force for pretensioning the holding means at the same magnitude.

Pursuant to another preferred specific embodiment of the present invention, the compensating mechanism comprises a housing that is connected to the holding means and a diaphragm that is disposed in this housing and is supported against the vessel via a rod, with the rod-end portion of the housing, which is partitioned by the diaphragm, communicating with the interior of the vessel via a line, and with the other portion of the housing communicating with the atmosphere. In this manner, the compensating mechanism is self regulating due to the communication of the housing with the vacuum in the vessel as a function of the vacuum that prevails there.

The displaceable guidance of the holding means provided on one end of the rod relative to the housing is effected via a tubular member that extends about a cylindrical extension of the vessel wall and that is displaceably guided on this extension, with the guidance being effected via a pin/slot connection. This displaceable guidance is completed in a vacuum-tight manner via a bellows that extends about the same.

Pursuant to another specific embodiment of the present invention, not only several spring arrangements but also several compensating mechanisms are distributed over the periphery of the graphite rod, with the total surface area of the diaphragms of all of the compensating mechanisms corresponding to the reaction area of the vacuum that prevails in the vessel in the region of the openings in the wall of the vessel.

Pursuant to a further specific embodiment of the present invention, a ball box or sleeve is disposed between the contact ring and the bushing of the holding means, with an imaginary center point of the ball box being disposed on the longitudinal center line of the rod, so that the contact ring with the clamping means and the contact stud is movable relative to the bushing of t he holding means. Since an identical arrangement of the holding means themselves is provided at both ends of the graphite rod, it is possible, after the graphite rod has been introduced, to effect an alignment of the rod with the adapter and contact stud, thereby being able to avoid or compensate for stresses relating to the manufacture.

Further specific features of the present invention will be described in detail subsequently.

DESCRIPTION OF PREFERRED EMBODIMENTS

Referring now to the drawings in detail, FIG. 1 shows a vessel 10 that has an outer wall 11, on the inside of which is disposed a refractory lining 12. The vessel is closed off in a vacuum-tight manner by means of a cover 13 in which is located a connection 14 to a non-illustrated vacuum pump. The vessel wall 11 as well as the lining 12 have diametrically oppositely disposed openings 15 for receiving a graphite rod 16 that is guided therethrough and that, via adapters 17, is held at both ends in mounting means 18 connected to the ends of the rod. In a manner to be described in detail subsequently, one of the mounting means 18 is connected to the vessel wall 11, while the other mounting means 18 is displaceably supported relative to the wall 11. The mounting means 18 also serve for the connection of power supply lines 19.

Figure 2:
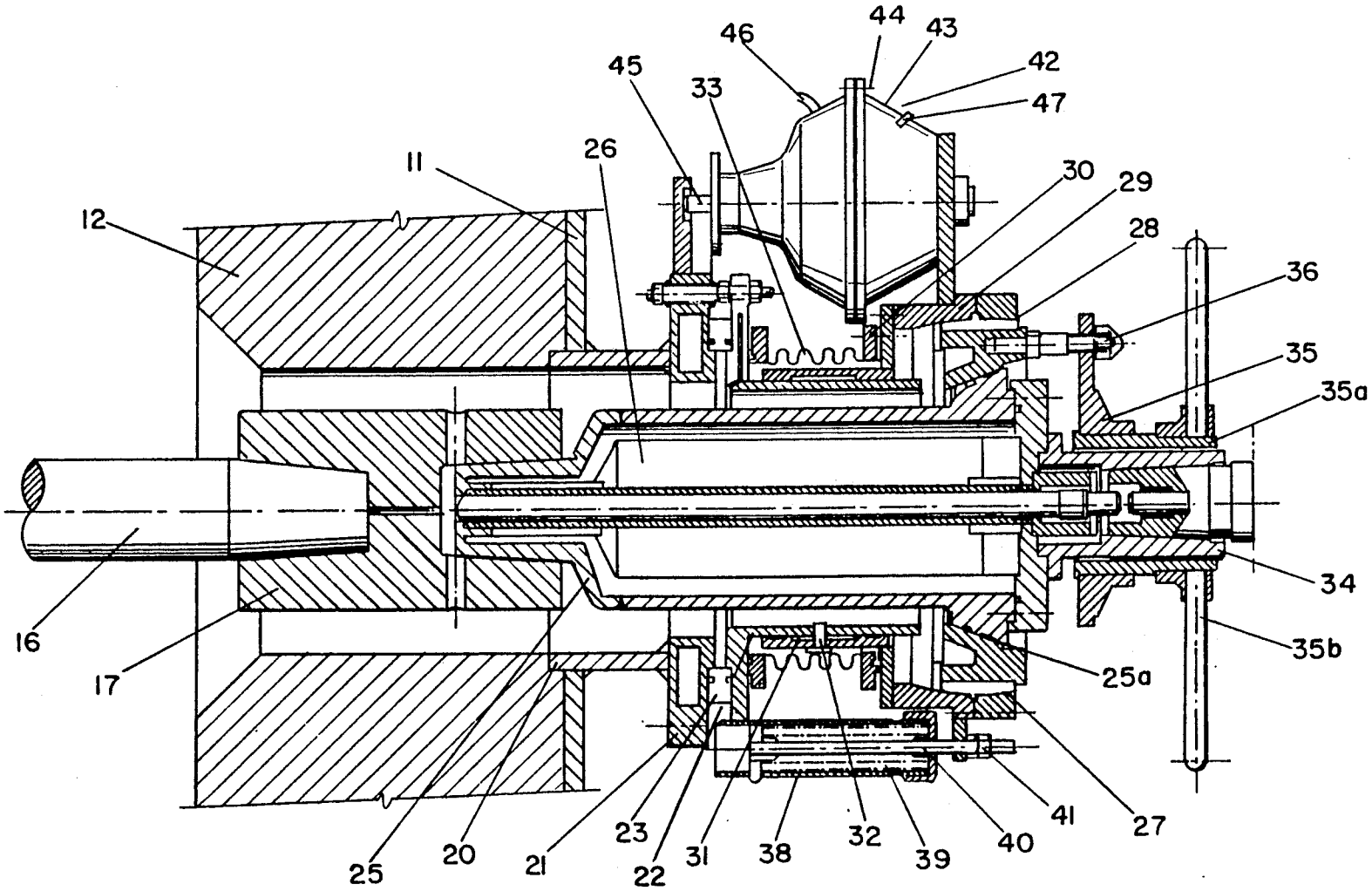
FIG. 2 is an enlarged cross-sectional view of the movable holding means for the graphite rod.

FIG. 2 is an enlarged view of one end of the graphite rod 16 with the pertaining mounting means 18; to compensate for movements relative to the vessel 10 resulting from temperature and vacuum conditions, this end of the rod 16 is disposed in such a way that it is displaceable relative to the vessel wall 11. For this purpose, by means of an intermediate piece 20 that is welded to the vessel wall 11 and surrounds the opening 15, a flange 21 is provided on which is mounted a cylindrical extension 22, with an electrically insulating seal 23 being interposed therebetween.

The end of the graphite rod 16 is primarily held in the adapter 17 in the thus formed continuation of the opening 15, which is integral with the housing. The adapter 17, in turn, is placed upon the end of a contact stud 25, which is preferably made of copper, in order to be able to transfer to the graphite rod 16 electrical energy that is introduced via the power-conducting contact stud 25. For this purpose, the adapter 17 itself is generally made of graphite. The contact stud 25 can be cooled, preferably with water, via the lines indicated by the reference numeral 26 At its outer end, the contact stud 25 is wider and is provided with an inclined contact surface 25*a*, upon which is seated a contact ring 27 that in turn is connected with the power supply 19.

Accompanied by the interposition of a ball box or sleeve 28, the contact ring 27 is fixed in an outer bushing 29 that is displaceably guided on the cylindrical extension 22 via a tubular member 30 that extends over the cylindrical extension 22 of the housing or vessel wall 11. To improve the guidance, a slot 31 is disposed in the extension 22, with a pin 32 that is disposed on the tubular member 30 extending into the slot 31. To produce a vacuum seal at this separation location between the mounting means 18 and the vessel wall 11, a bellows means 33 is provided, one end of which is secured to the flange 21 that is fixed on the vessel wall 11, and the other end of which is secured to the outer bushing 29 of the mounting means 18.

In order to replace the graphite rod 16 after it has been burned up or consumed, it must be possible to remove the rod from the vessel 10. For this purpose, the rod 16, along with the adapter 17 and the contact stud 25, can be removed in an axial direction from the contact ring 27 via a connection member 34 that is connected to the contact stud 25. Rotatably and threadedly mounted on the outer surface of the connection member 34 are a clamping sleeve 35*a* and a clamping ring 35, so that when a handwheel 35*b* is turned, the contact stud 25 and the contact ring 27 are released from one another at the inclined contact surface 25*a*. In order after a new rod 16 has been introduced into the vessel 10 to be able to establish an adequate contact between the contact stud 25 and the contact ring 27, a clamping ring 35 is rotatably mounted on the clamping sleeve 35*a*. When the handwheel 35*b*, which is fixedly connected to the clamping sleeve 35*a*, is turned, the clamping ring 35, by means of a threaded connection between the connection member and the clamping sleeve 35*a*, is pressed against the heads of the clamping bolts 36 that are disposed about the periphery. As the clamping ring is tightened, the connection member 34 exerts an axial force upon the contact stud 25, so that the inclined surface 25*a* of the contact stud 25 is pressed against the contact ring 27, thereby insuring a good transfer of current.

Since the contact ring 27 is held in the outer bushing 29 of the mounting means 18 via the ball box 28, prior to final mounting of the rod 16, the contact ring 27 can be rotated relative to the outer bushing 29, so that both ends of the graphite rod can be aligned. This might be necessary, for example, if the graphite rod, in the axial direction, has manufacturing discrepancies that can be compensated for by altering the respective position of the ends of the rod relative to one another. In this manner, it is possible to keep manufacturing-related stresses from the rod 16.

Consequently, from the previous explanation there results for the graphite rod 16 a mounting means 18 that is comprised of the adapter 17, the contact stud 25, and the contact ring 27 with the clamping ring 35 and the outer bushing 29. As such, the mounting means 18 is displaceable on the cylindrical extension 22 of the vessel wall 11, relative to the vessel, via the tubular member 30 that is disposed on the bushing 29.

Due to the free displaceability of the mounting means 18 relative to the vessel 10, it is necessary, for the heating operation, to prescribe a defined engagement pressure so that the ends of the graphite rod 16 are appropriately fixed in position in the pertaining adapters 17 to thereby insure an energy transfer to the graphite rod 16 that is as loss-free as possible. This preload, which acts upon the graphite rod 16 and into the interior of the vessel 10, is produced by disposing a spring cage 38 on the cylindrical extension 22 of the vessel wall 11, with a spring bolt 40, which is connected with the mounting means 18, and in particular with the outer bushing 29 thereof, being displaceable in this spring cage 38, with the spring cage 38 and the spring bolt 40 being mounted relative to one another via a spring 39. Tightening means 41 are disposed on the spring bolt 40 so that by means of the spring arrangement 38, 39, 40 a force can be exerted that is directed in a direction toward the interior of the vessel.

If a vacuum is now applied to the interior of the vessel 10, this vacuum magnifies the force emanating from the spring arrangement 38, 39, 40, so that the engagement pressure of the mounting means 18 upon the graphite rod 16, which of course is desired to a certain extent, becomes too great. To act against this force, a compensating mechanism 42 is provided that is constructed as follows. Connected with the mounting means 18, and in the illustrated embodiment actually with the outer bushing 29, is a pressure-tight housing 43, the interior of which is divided by a diaphragm 44. By means of a rod 45 that projects out of the housing 43, the diaphragm 44 is supported relative to the vessel wall 11, and in particular relative to an extension of the flange 21 thereof. This rod-side portion of the interior of the housing 43 communicates via a line 46 with the interior of the vessel 10, so that in this portion of the housing 43 there always exists the same vacuum that prevails in the interior of the vessel 10. In contrast, the interior of the housing 43 that is on the other side of the diaphragm 44 communicates via an opening 47 with the atmosphere.

At this point, if there is a vacuum in that portion of the interior of the housing 43 that communicates with the vessel 10, t he diaphragm 44 arches in a direction toward the vessel 10, so that by means of the rod 45, the housing 43, and hence the entire mounting means 18, is moved away from the vessel 10. In so doing, a movement is produced that is directed opposite to the engagement force produced by the spring arrangement 38, 39, 40, so that the reinforcement of the engagement force resulting from the vacuum is compensated for by the compensating mechanism 42.

In this connection, pursuant to the present invention not only are a plurality of spring arrangements 38, 39, 40 distributed over the periphery of the mounting means for the graphite rod 16, but rather in a similar manner a plurality of compensating mechanisms 42 are also provided, whereby the total surface area of the diaphragm 44 of all of the compensating mechanisms 42 corresponds to the overall effective surface area that the vacuum in the vessel 10 exerts upon the graphite rod 16 and its mounting means 18 via the opening 15. Thus, due to the equal surface area correlation, a force equilibrium is produced as a result of which, despite the vacuum that prevails in the interior of the vessel 10, ultimately only that engagement pressure acts upon the graphite rod 16 that is established by operational limits via the spring arrangement 38, 39, 40.

Figure 3:
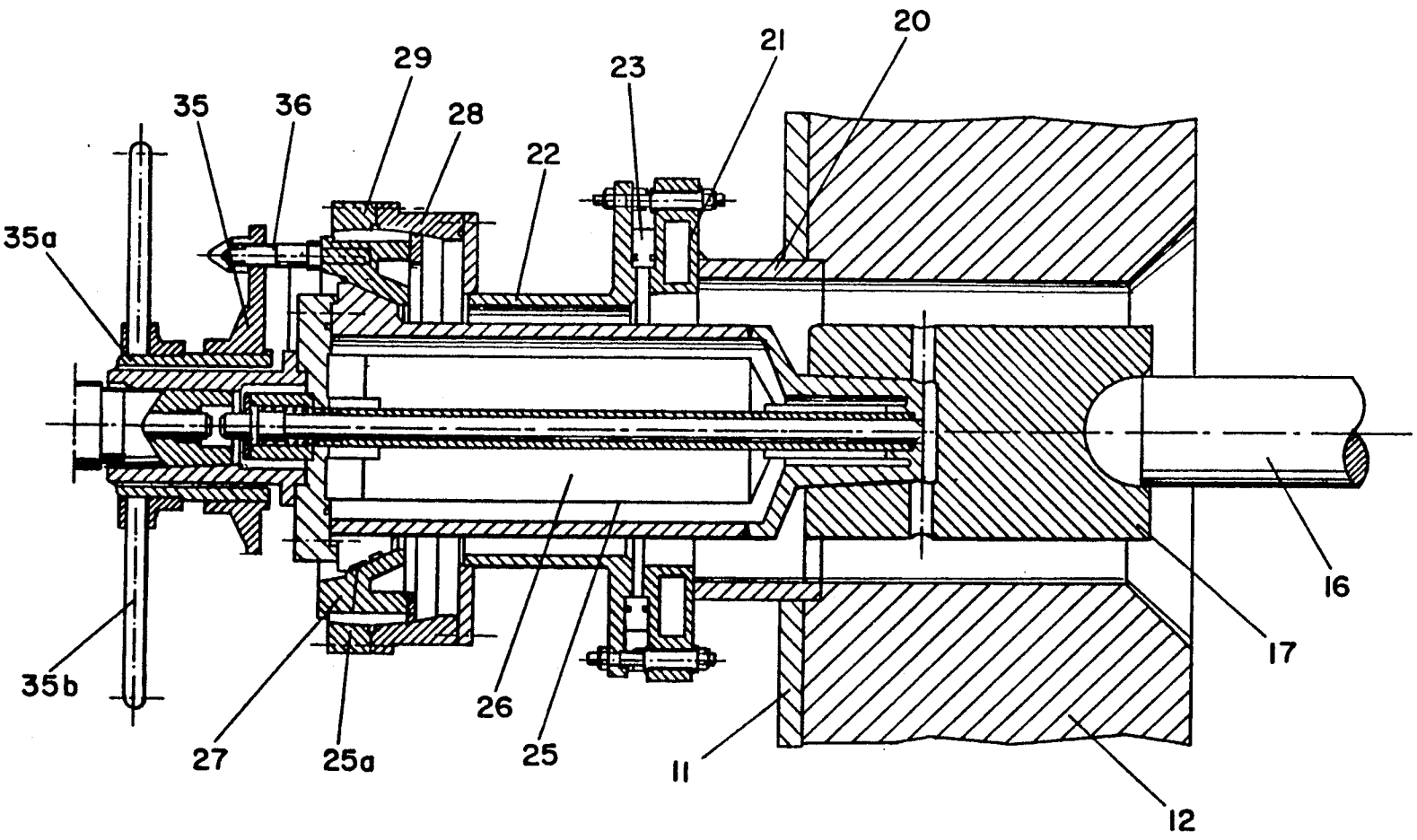
FIG. 3 is an enlarged cross-sectional view of the fixed holding means for the graphite rod.

FIG. 3 illustrates the mounting means 18 for the graphite rod 16 that pertains to the non-displaceable arrangement of the mounting means 18. A comparison of the illustrations of FIGS. 2 and 3 shows that with the so-called fixed mounting for the graphite rod, the mounting means 18 is embodied in a manner comparable to that described in connection with FIG. 2 for the so-called moveable arrangements 38, 39, 40 and the compensating mechanism 42. In other respects, the mounting means basically has the same construction because individual parts of this mounting means, such as the adapter or contact stud, must similarly be replaced when they become worn.

Generally, however, the graphite rod 16 is replaced only by being withdrawn at the moveable mounting shown in FIG. 2, whereby after a new graphite rod has been introduced, a centering of the free end of the graphite rod in the opposite adapter on the fixed mounting side is effected in that this end of the graphite rod has a spherical configuration and the adapter of the fixed mounting has a corresponding spherical indentation.

The present invention is, of course, in no way restricted to the specific disclosure of the specification and drawings, but also encompasses any modifications within the scope of the appended claims.

What we claim is:

1. In a vessel for processing steel under vacuum, and including a vessel body having wall means, a cover placed on said vessel body in a vacuum-tight manner, and a connection for a vacuum pump, whereby to heat said vessel a heating means is provided that comprises a graphite rod that extends diametrically through said vessel, with contact studs being provided at the ends of said graphite rod for the transfer of electrical power, the improvement comprising:

a first fixed mounting means for fixedly holding one end of said graphite rod, and the pertaining contact stud, in position on said vessel wall means in a non-displaceable manner;

a second displaceable mounting means for disposing the opposite end of said graphite rod, and the pertaining contact stud, on said wall means in a displaceable manner;

a compensating mechanism for supporting said second displaceable mounting means of said graphite rod, with said compensating mechanism being acted upon by vacuum from said vessel and serving to compensate for the force originating from the vacuum that prevails in said vessel; said compensating mechanism comprising a housing, which is connected to said second displaceable mounting means, and a diaphragm, which is disposed in said housing and partitions same, said diaphragm being supported against said vessel wall means via a rod, with said rod-end portion of said housing communicating with said vessel via a line, and with the other portion of said housing communicating with the atmosphere.

2. A vessel according to claim 1, in which each of said mounting means comprises an adapter for receiving the pertaining end of said graphite rod, one of said contact studs, a contact ring that is in contact with said contact stud and is provided with connections for a power supply means, an outer bushing that surrounds said contact ring, and a clamping means for said contact stud.

3. A vessel according to claim 2, which, for providing a pretension, includes a spring arrangement that is disposed between said vessel wall means and said second mounting means that is displaceable relative thereto; and in which said compensating mechanism is supported between said wall means and said second displaceable mounting means and counteracts the spring force of said spring arrangement.

4. A vessel according to claim 3, in which said vessel wall means is provided with a cylindrical extension, and said bushing of said second displaceable mounting means is provided with a tubular member that extends about said cylindrical extension to effect said displaceable disposition of said second mounting means, with a pin and slot connection being provided for guiding said mounting means.

5. A vessel according to claim 4, which includes, in order to establish a vacuum seal between said vessel and said second displaceable mounting means, a bellows that extends about said tubular member, with said bellows having a first end that is secured to a portion of said vessel wall means, and a second end that is secured to said mounting means.

6. A vessel according to claim 3, which includes several spring arrangements and several compensating mechanisms distributed over the periphery of said second displaceable mounting means.

7. A vessel according to claim 6, in which the total surface area of said diaphragms of all of said compensating mechanisms corresponds to the reaction surface of the vacuum that prevails in said vessel.

8. A vessel according to claim 3, in which a ball box is disposed between said contact ring and said outer bushing, with said ball box having an imaginary center point that is disposed on a longitudinal center line of said graphite rod, so that said contact ring, clamping means, and contact stud are movable relative to said outer bushing.

* * * * *